United States Patent [19]

Murdock

[11] 4,326,184

[45] Apr. 20, 1982

[54] ELECTRIC CUTOUT

[75] Inventor: Robert E. Murdock, Stone Mountain, Ga.

[73] Assignee: Kearney-National Inc., Atlanta, Ga.

[21] Appl. No.: 174,823

[22] Filed: Aug. 4, 1980

[51] Int. Cl.[3] ..... H01H 71/10

[52] U.S. Cl. ..... 337/168; 337/172; 337/181

[58] Field of Search ..... 337/168, 169, 171, 172, 337/174, 180, 181

[56] References Cited

U.S. PATENT DOCUMENTS

| | | | |
|---|---|---|---|
| 2,235,666 | 3/1941 | Birkenmaier | 337/180 X |
| 2,275,831 | 3/1942 | Williams, Jr. et al. | 337/174 X |
| 2,328,818 | 9/1943 | Lindeu et al. | 337/180 X |
| 2,910,560 | 10/1959 | Stroup et al. | 337/180 X |

OTHER PUBLICATIONS

Open Fuse Cutouts, Dec., 1961, 8 pages, descriptive bulletin, 38-620, copy in 337-171.

*Primary Examiner*—George Harris
*Attorney, Agent, or Firm*—Rodgers & Rodgers

[57] ABSTRACT

An electric cutout includes a fuseholder in which a fusible element is mounted, a conducting element pivotally mounted to the lower end of the fuseholder and having a pair of trunnions disposed within a pair of spaced jaws on which a pair of guide surfaces are respectively mounted for cooperation with complementary guiding surfaces of arcuate configuration on the conducting element so that rotation of the fuseholder and conducting element about the trunnions may be effected in such manner that the trunnions are securely held against the bight portions of the jaws thereby to prevent rocking action of the fuseholder during closing movement thereof, an ejector latching element pivotally mounted on the conducting element and arranged to eject the fusible element upon rupture thereof and also arranged to engage a part of the fuseholder so as to prevent relative movement between the conducting element and the fuseholder, a U-shaped contact fixed in position adjacent the jaws and arranged to engage opposite surfaces of the conducting element so as to form a low impedance contact therebetween, and yieldable latching means fixed in position and arranged for engagement by latch elements formed on the upper end of the fuseholder and constituting conducting portions of the circuit through the cutout.

13 Claims, 6 Drawing Figures

Fig. 4
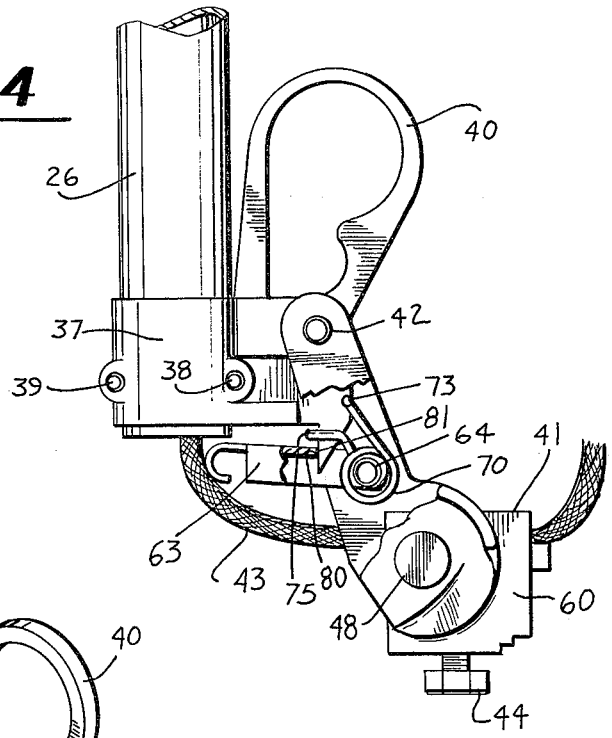
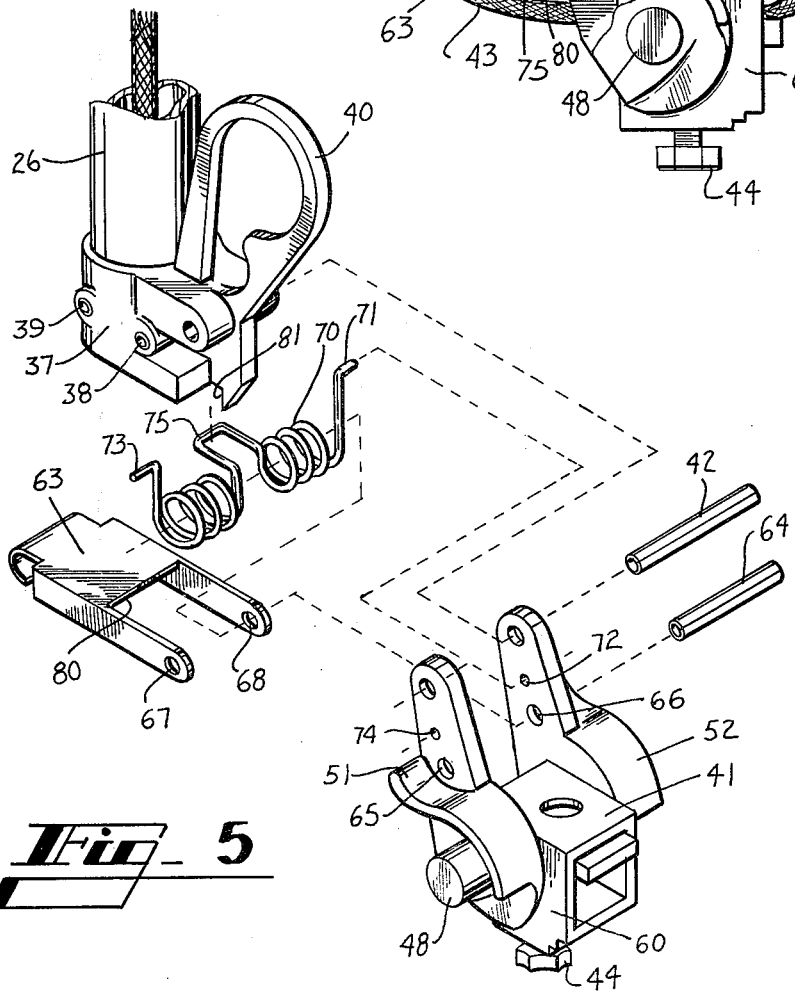
Fig. 5

ELECTRIC CUTOUT

TECHNICAL FIELD

This invention relates to electric cutouts used as protective devices in electrical distribution systems.

BACKGROUND ART

Electric cutouts are well known in which an insulator is arranged for mounting on a structure such as a power line pole cross arm and which supports upper and lower terminals connected with a distribution circuit and in which a fuseholder having an upper contact is removably mounted for interconnection between the cutout terminals. It is customary to provide a double hinge support for the lower end of the fuseholder which is provided with trunnions for engaging spaced jaws so that the fuseholder is initially mounted with the trunnions arranged in the jaws and is then rotated about the trunnions to cause the upper contact to become engaged with the upper terminal. It is possible that the trunnions do not remain snugly within the bight portions of the jaws so that the upper contact of the fuseholder does not engage the upper terminal properly. An example of such structure is disclosed in U.S. Pat. No. 2,721,242.

One known means of interconnecting the conducting element and the lower terminal of a cutout utilizes a biased contact mounted on the lower terminal which engages the conducting element at a single point. While this type of contact is ordinarily satisfactory, it may result in improper contact if the bias becomes weakened for any reason. A cutout having a contact of this type is disclosed in U.S. Pat. No. 2,721,242.

According to known latch mechanisms pivotally mounted parts associated with the top terminal of a cutout are utilized to latch the top portion of the fuseholder in its service position. These movable elements of course are not always reliable and may form an insecure latched condition. A cutout having a movable pivotally mounted latch is disclosed in U.S. Pat. No. 2,721,242.

DISCLOSURE OF INVENTION

According to this invention in one form, the jaws of an electric cutout are provided with guide surfaces respectively and a pair of complementary guiding surfaces are formed about the trunnions of a conducting element for respectively engaging the guide surfaces so as to prevent rocking, unstable, swinging movement of a fuseholder during closing rotation thereof and a U-shaped contact is mounted at its bight portion on the lower terminal of a cutout and the prongs thereof envelop the conducting hinge element so as to establish efficient and reliable contact therebetween while an ejector latching element is pivotally mounted on the conducting hinge element and is engageable with the fuse link conductor to eject such conductor following operation of the fusible element and is also engageable with a part of the fuseholder to prevent movement of the conducting hinge element relative to the fuseholder during normal unmelted conditions of the fusible element.

According to a feature of the invention, the upper terminal comprises a yieldable latching conductive means engageable with latch elements mounted on the fuseholder contact and having substantially flat inclined entry portions and having arcuate latching portions.

BRIEF DESCRIPTION OF THE DRAWINGS

In the drawings

FIG. 4 is an assembly view of the parts shown in FIG. 3 as viewed from the opposite side from that depicted in FIG. 3 and in which FIG. 5 is an exploded view of the lower portion of a fuseholder and parts associated therewith as seen from the opposite side from that shown in FIG. 3.

BEST MODE OF CARRYING OUT THE INVENTION

Figure 1:
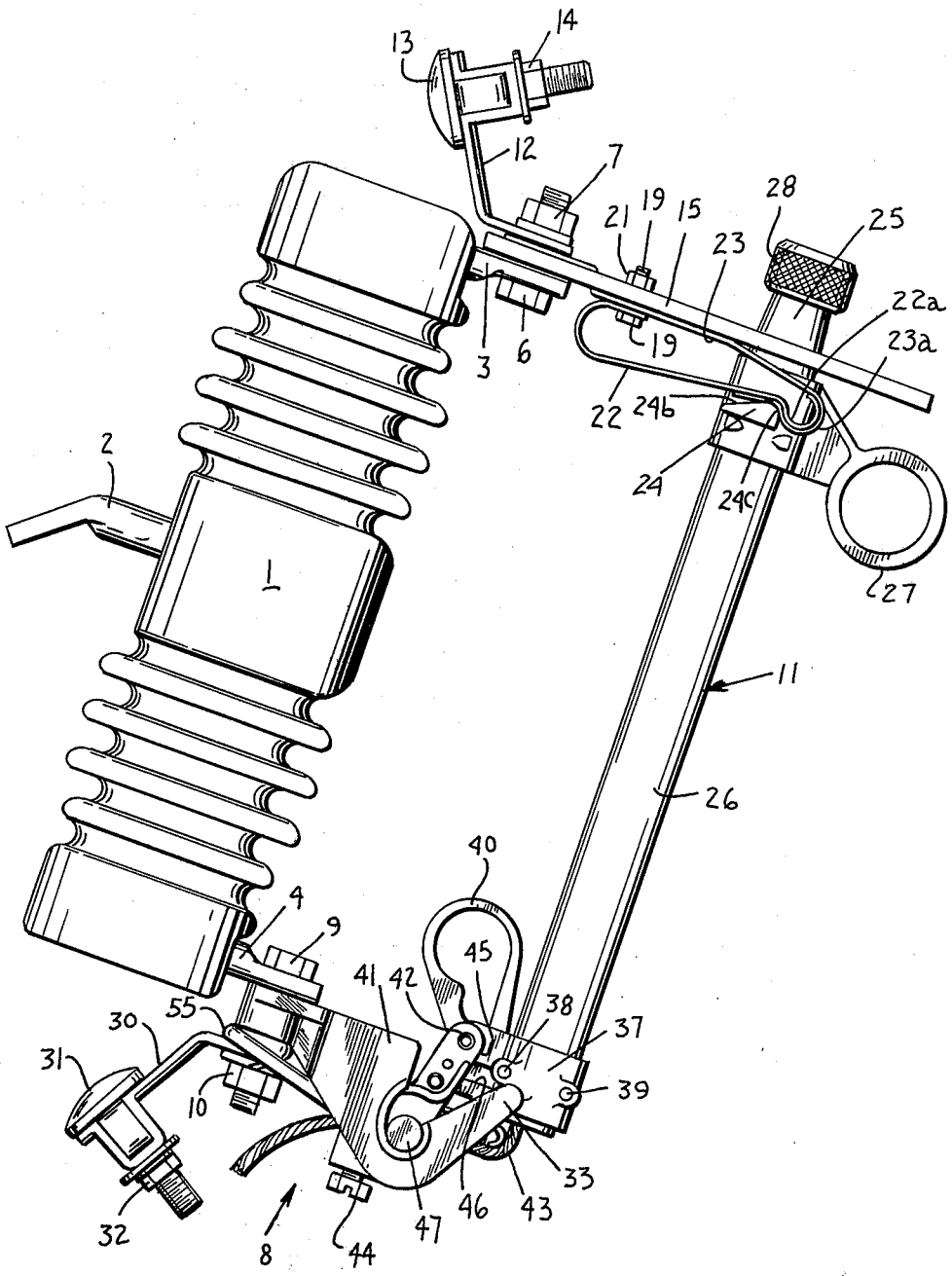
FIG. 1 is a side view of an electric cutout formed according to this invention.

In FIG. 1 the numeral 1 designates a conventional insulator provided with a supporting bracket 2. As is well known, supporting bracket 2 is secured by suitable means to supporting structure such as the cross arm of an electric line pole. Secured to the upper end of insulator 1 is a mounting bracket 3 while a similar mounting bracket 4 is secured to the lower end of insulator 1.

The upper terminal generally designated by the numeral 5 is secured to bracket 3 by means of bolt 6 and associated nut 7 while the lower terminal generally designated by the numeral 8 is secured to bracket 4 by means of bolt 9 and nut 10. The fuseholder generally designated by the numeral 11 interconnects the lower terminal 8 with the upper terminal 5 when in closed circuit position as shown in FIG. 1. As is well known a fusible element is mounted within the fuseholder and is electrically connected with terminal 5 and 8.

Upper terminal 5 includes a terminal stud 12 secured in place by bolt 6 and nut 7 and provided with connecting bolt 13 and its associated nut 14 which constitute means for interconnecting a distribution circuit conductor with the upper terminal 5 of the cutout. Terminal element 15 is supported on bracket 3 by bolt 6 and nut 7 and includes a pair of prongs 16 and 17 as is best shown in FIG. 2.

For holding the fuseholder 11 in its closed circuit position as shown in FIG. 1, latching means is provided and includes a spring element constructed of spring material identified by the numeral 22 which is mounted to terminal element 15 by means of the bolt 19 and the nut 21. The right hand end of spring element 22 is in the form of an arcuate element **22*a* and is enveloped within a complementary arcuate portion 23*a* of a yieldable conducting element 23. Conducting element 23 is also mounted by bolt 19 and nut 21 and is secured in contact with terminal stud 12 by bolt 7. Similar spring 22*b* and associted yieldable conducting element 23*b* are formed alongside spring 22 and yieldable conductor 23 as is apparent from FIG. 2 and are secured by bolt 18 and nut 20 as well as by bolt 7. Instead of bolts 18 and 19** and their associated nuts, it might be desirable to use suitable rivets.

For engaging the latching means comprising spring 22 and yieldable conducting element 23, a latch element 24 is intergrally formed with the metallic contact 25 which is secured atop the fuse tube 26 which is formed of insulating material. Contact 25 of course is formed of conducting material and is provided with a manipulating ring 27 and a closure cap 28 of known structure and function. Terminal 25 is secured to the fuse tube 26 by pin 29 and by a similar pin on the other side of the fuseholder but which is not observable in the drawings. Similarly a latch element 24*a* is integrally formed with the contact 25 and cooperates with spring element 22*b* and yieldable conducting element 23*b*.

Figure 2:
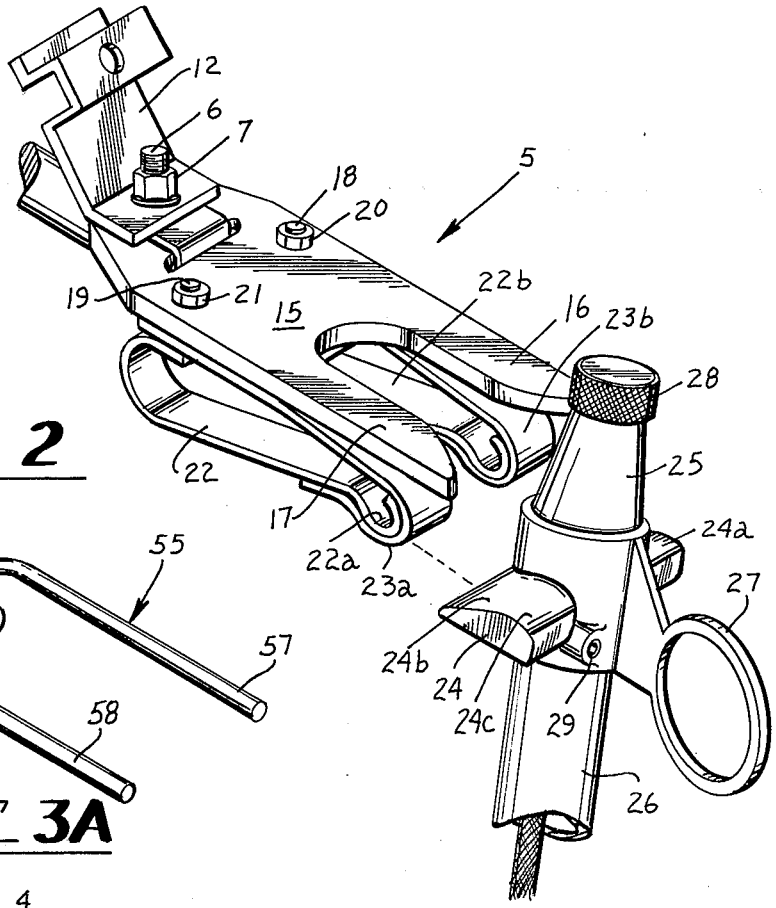
FIG. 2 is a perspective somewhat exploded view of the upper portion of a fuseholder and of an upper terminal formed according to this invention.

As is apparent in FIGS. 1 and 2, the latch elements are of special configuration. For example, latch element 24 is provided with a substantially flat inclined entry portion 24*b* and with an arcuate latching portion 24*c*. Thus as the fuseholder is manipulated from the position indicated generally in FIG. 2 to the closed position shown in FIG. 1, the arcuate portion 23*a* is first engaged by the entry portion 24*b* which smoothly biases the spring 22 and the yieldable conductor 23 upwardly. After the latching portion 24*b* of latch element 24 rides to the left of arcuate portion 23*a* of yieldable conductor 23, the parts are held securely in closed position as shown in FIG. 1 with the latching portion 24*c* of latch element 24. Similar operation of latch 24*a* and of parts 22*b* and 23*b* occurs simultaneously.

The lower terminal 8 includes terminal stud 30 mounted by bolt 9 and nut 10 on bracket 4. Connecting bolt 31 and associated nut 32 are used in known manner to form a connection with a distribution line conductor. Lower terminal 8 also includes a pair of laterally spaced jaws 33 and 34 having bight portions 35 and 36.

The structure associated with the lower end of the fuse tube 26 comprises a collar 37 secured to the lower end of fuse tube 26 by means of a pair of pins 38 and 39 which are of known structure and function and a hook 40 is integrally formed with collar 35 and is arranged to receive a part of a hook stick to facilitate mounting the fuseholder and the associated fusible element in known manner.

Pivotally connected with the collar 37 is a conducting hinge element 41. The pivotal connection between collar 37 and conducting element 41 is by means of pin 42. Conducting element 41 is maintained in the position indicated in FIGS. 1 and 3 by means of conductor 43 which extends into fuse tube 26 and connects with the fusible element not shown. Conductor 43 is secured by bolt 44 to conducting hinge element 41 so that the part 45 of conducting element 41 is held in abutting relationship with the stud 46 integrally formed on collar 37. Similar parts on the other side of the structure cooperate in a similar fashion.

Figure 3A:
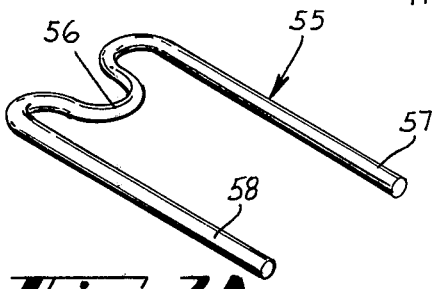
FIG. 3A is a perspective view of a U-shaped contact forming a part of the lower terminal structure.
Figure 3:
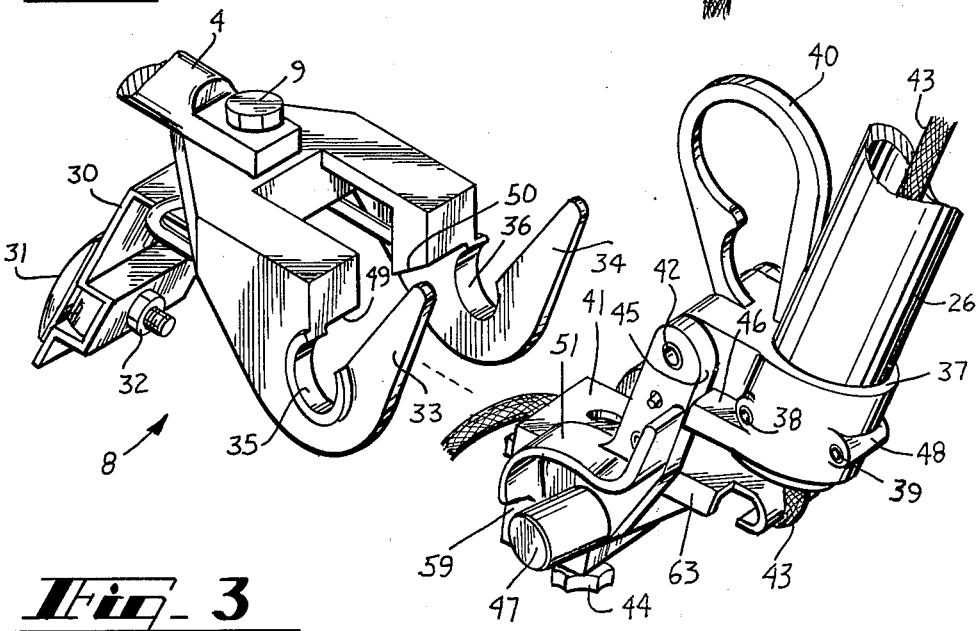
FIG. 3 is a perspective somewhat exploded view of the lower portion of a fuseholder and its associated jaws formed according to a feature of the invention.

With the fuseholder armed with a fuse link and having a button head in contact with contact 25 and with the conductor 43 secured in position by bolt 44 as indicated in FIGS. 1 and 3, the fuseholder may be mounted in its closed circuit position by simply inserting a hook stick through the hole 40 and by elevating the fuseholder upwardly to allow the trunnions 47 and 48 to enter the jaws 33 and 34. Thereafter the hook stick is removed from aperture 40 and is inserted into the ring 27 and pushed upwardly. This swings the fuseholder in a counterclockwise direction about the trunnions 47 and 48 as viewed in FIGS. 1 and 3 and causes the latch elements 24 and 24*a* to slide underneath the latching means 22 and 23 so that the parts then occupy the positions shown in FIG. 1.

Since the counterclockwise swinging movement of the fuseholder due to upward pressure on a hook stick inserted into ring 27 could apply an unbalanced force to the fuseholder, it is possible that the fuseholder might rock about its trunnions. If sufficient rocking motion should occur, the terminal 25 will not slide between the prongs 16 and 17 and an arc would then be established between the terminal 25 and the terminal element 15 or closely associated parts which would be very difficult if not impossible to extinguish without serious damage to the structure. Also rocking motion could cause serious mechanical damage.

This possibility is overcome in accordance with one feature of this invention. With reference to FIG. 3, the jaw structure 33 is provided with a guide surface 49 while the jaw 34 is provided with a guide surface 50. Complementary guide surfaces 51 and 52 are formed on conducting hinge element 41 so that with a hook stick in engagement with ring 27 and with the trunnions 47 and 48 mounted in the jaws 33 and 34, upward motion of the hook stick and rotation of fuseholder 11 counterclockwise about trunnions 47 and 48 cause the complementary guiding surface 51 to ride underneath the guide surface 49. Simultaneously the guide surface 52 rides underneath the guide surface 50 in snug contact therewith throughout the counterclockwise rotation of the fuseholder into its closed circuit position because all parts of the arcuate portions of complementary guiding surface 51 are equidistant from the axis of trunnion 47 and all portions of the complementary guide surface 52 are equidistant from the axis of trunnion 48. Because of the snug contact between guiding surfaces 51 and 52 relative to guide surfaces 49 and 50, the trunnions 47 and 48 are maintained in snug secure engagement with the bight portions 35 and 36 respectively of the jaws 33 and 34. By this means sidewise wobbling of the fuseholder is prevented and effective cooperation of the latch elements 24 and 24*a* with the yieldable latching means 22, 23 and 22*b* and 23*b* is insured according to one aspect of this invention.

For the purpose of insuring good electric contact between the terminal element 30 and the conducting hinge element 41, a generally U-shaped contact 55 is provided as is best shown in FIG. 3A. Contact 55 is provided with a projecting bight portion 56 which receives the bolt 9 thereby to effect good firm element contact between U-shaped contact 55 and terminal element 30. The prong 58 of contact 55 is arranged to engage the side 59 of conducting hinge element 41. In like fashion prong 57 engages the opposite side 60 of conducting hinge element 41.

During normal service conditions, the circuit through the unit as is well known is through the conductor 12 the yieldable latch conductor 23 and 23*b*, the latch elements 24 and 24*a*, the contact 25, the fusible element and the conductor 43 through the conducting hinge element 41, the U-shaped conductor 55, to the terminal connector 30.

For the purpose of securing the conducting hinge element 41 in the position indicated in FIGS. 1 and 3 relative to the collar 37 and also for the purpose of ejecting the lower end of the fusible element within fuse tube 26 downwardly and outwardly from the lower end of the fuse tube, an ejector latching element 63 is provided. Ejector latching element 63 as best shown in FIG. 5 is pivoted by a pin 64 to the conducting hinge element 41. Pin 64 is inserted into holes 65 and 66 formed in conducting hinge element 41 and also through holes 67 and 68 formed in ejector latching element 63 so that that element is effectively pivotally mounted on the conducting hinge element 41. Latching element 63 is biased downwardly in a counterclockwise direction as shown in FIGS. 4 and 5 by means of a helical spring 70. The end 71 of spring 70 is inserted into aperture 72 in conducting hinge element 41 while the end 73 of spring 70 is inserted into aperture 74 formed in conducting hinge element 41. The center portion 75 of spring 70 engages the upper surface of ejector latching element 63 and biases that element downwardly in a counterclockwise direction as viewed in FIGS. 4 and 5. Thus an interruption of the fusible element disposed within the fuse tube 26 results in counterclockwise rotation of ejector latching element 63 as shown in FIG. 4 and the ejection of conductor 43 from the fuse tube 26. Simultaneously and in known manner the conducting element 41 rotates in a clockwise direction about the trunnions 47 and 48 and this motion allows the fuseholder 11 to move downwardly and releases the latch elements 24 and **24*a* from the yieldable latching means 22, 23 and 22*b*, 23*b*. The fuseholder swings downwardly to occupy a lowermost position suspended by the trunnions 47 and 48**.

During assembled condition of the fuseholder with the parts in the positions represented in FIG. 1 the downward biasing action of spring 22 and yieldable conductor 23 and cooperating parts during closing operations as well as the weight of the fuseholder tend to impose a stress on the fuse link and on conductor 43. To preclude damage to the fuse link the ejector latching element is arranged so that its bight portion 80 engages the downwardly projecting stud 81 formed intergrally with collar 37. This latching engagement effectively precludes rotation of the conducting hinge element 41 in a counterclockwise direction about the pin 42 as viewed in FIG. 5 and relieves the conductor 43 and the fuse link of tension stress.

INDUSTRIAL APPLICABILITY

By this invention conventional distribution electric cutouts are substantially improved and structural features as described are provided for improving the efficiency and reliability of electric cutouts.

I claim:

1. An electric cutout comprising a fuseholder, a conducting element mounted on one end of said fuseholder and having a pair of coaxial trunnions on opposite sides thereof, a lower terminal element including a pair of spaced jaws having bight portions arranged to receive said trunnions respectively, a pair of spaced guide surfaces on said jaws, and a pair of spaced complementary guiding surfaces on said conducting element and spaced substantially equidistant from the axis of said trunnions for engagement with said guide surfaces respectively so that said trunnions are maintained in close contact with the bight portions of said jaws during predetermined rotation of said conducting element relative to said terminal element.

2. An electric cutout according to claim 1 wherein said complementary guiding surfaces are of arcuate configuration.

3. An electric cutout according to claim 1 wherein an electric contact is mounted on the other end of said fuseholder and wherein an upper terminal having spaced prongs is arranged to receive said electric contact between said prongs in coordination with predetermined rotation of said fuseholder about said trunnions as a center.

4. An electric cutout according to claim 1 wherein a yieldable generally U-shaped contact structure is mounted on said lower terminal and engageable with said conducting element.

5. An electric cutout according to claim 4 wherein the prongs of said generally U-shaped contact structure are engageable respectively with parts of said conducting element which are on opposite sides thereof.

6. An electric cutout according to claim 1 wherein a latch element is mounted on the other end of said fuseholder and wherein an upper terminal includes yieldable latching means arranged to engage and disengage said latch element.

7. An electric cutout according to claim 6 wherein said latch element includes a latching surface whose entry portion is substantially flat and disposed to cause said yieldable latching means to move upwardly during a latching operation and whose latching portion is arcuate in cross section.

8. An electric cutout according to claim 7 wherein said yieldable latching means includes a latching portion which is arcuate in cross section and generally complementary to said latching portion of said latching surface.

9. An electric cutout according to claim 6 wherein a pair of latch elements are mounted on diametrically opposite parts of said fuseholder.

10. An electric cutout according to claim 3 wherein a latch element is formed integrally with said electric contact.

11. An electric cutout according to claim 9 wherein an upper terminal having spaced prongs is arranged to receive said electric contact between said prongs and wherein yieldable latching means is mounted on each of said prongs and arranged to engage said latch elements respectively.

12. An electric cutout according to claim 11 wherein said latch elements are formed integrally with said electric contact and wherein said yieldable latching means is in electric contact with said upper terminal.

13. An electric fuse according to claim 1 wherein said conducting element is pivotally mounted on said fuseholder and an ejector latching element is pivotally mounted on said conducting element and engageable with a part of said fuseholder so as to prevent movement of said conducting element relative to said fuseholder.

* * * * *